United States Patent [19]

Wilhide

[11] Patent Number: 4,660,289

[45] Date of Patent: Apr. 28, 1987

[54] ADJUSTABLE BOW SIGHT MOUNT

[76] Inventor: Robert A. Wilhide, 3763 Mahoning Ave., NW., Warren, Ohio 44483

[21] Appl. No.: 874,078

[22] Filed: Jun. 13, 1986

[51] Int. Cl.[4] ..... F41G 1/38; F41G 1/46

[52] U.S. Cl. ..... 33/247; 33/265

[58] Field of Search ..... 33/247, 248, 260, 265

[56] References Cited

U.S. PATENT DOCUMENTS

| | | | |
|---|---|---|---|
| 533,003 | 1/1895 | Dieffenbach | 33/260 |
| 1,459,944 | 6/1923 | Belding | 33/248 |
| 2,951,292 | 9/1960 | Buehler | 33/248 |
| 3,492,733 | 2/1970 | Leatherwood | 33/248 |
| 3,820,248 | 6/1974 | Hayward | 33/241 |
| 3,838,522 | 10/1974 | Williams | 33/251 |
| 4,528,973 | 7/1985 | Rasmussen | 33/265 |

FOREIGN PATENT DOCUMENTS

| | | | |
|---|---|---|---|
| 22921 | 1/1913 | Norway | 33/248 |

*Primary Examiner*—Richard R. Stearns

*Attorney, Agent, or Firm*—Harpman & Harpman

[57] ABSTRACT

An adjustable bow sight mount to be used with telescopic sights on crossbows. The bow sight mount is pivotally secured to the crossbow for vertical adjustment providing a universal mounting plate for different telescopic sights.

4 Claims, 3 Drawing Figures

ADJUSTABLE BOW SIGHT MOUNT

BACKGROUND OF THE INVENTION

1. Field of the Invention

This invention relates to adjustable bow sight mounts of the type that are used on gun or bow stocks on to which a telescopic sight can be positioned.

2. Description of the Prior Art

Prior art devices of this type have been directed to moveable gun sights. See for example U.S. Pat. Nos. 3,838,522 and 3,820,248 and U.S. Pat. No. 3,492,733.

In U.S. Pat. No. 3,838,522, a gun sight is disclosed that has two points of adjustment both vertically and transversely of the gun stock using a set screw and an elongated sight body which is deflected by advancement of a secondary adjustment screw engageable against the gun stock.

In U.S. Pat. No. 3,820,248, an illuminated gun sight is disclosed having a complete scope for use in nightime situations including a single adjustable point of attachment utilizing a screw thread and lock nut combination.

U.S. Pat. No. 3,492,733 discloses a sighting scope having an adjustable mounting bracket which is secured to the gun stock at one end with an area of reduced thickness adjacent thereto which is deflected i.e. (bent) as the vertical adjustment screw is advanced against the stock on the other end.

SUMMARY OF THE INVENTION

An adjustable bow sight mount for use on crossbows. Has a nonadjustable point of attachment to the gun stock that pivots the entire mount in accordance with the vertical adjustment input via a second point of attachment by the utilization of a threaded advance stud on a bracket member extending there from. The sight mount can be adjusted vertically in relation to its pivot point of attachment with the bow stock.

DESCRIPTION OF THE PREFERRED EMBODIMENT

Figure 1:
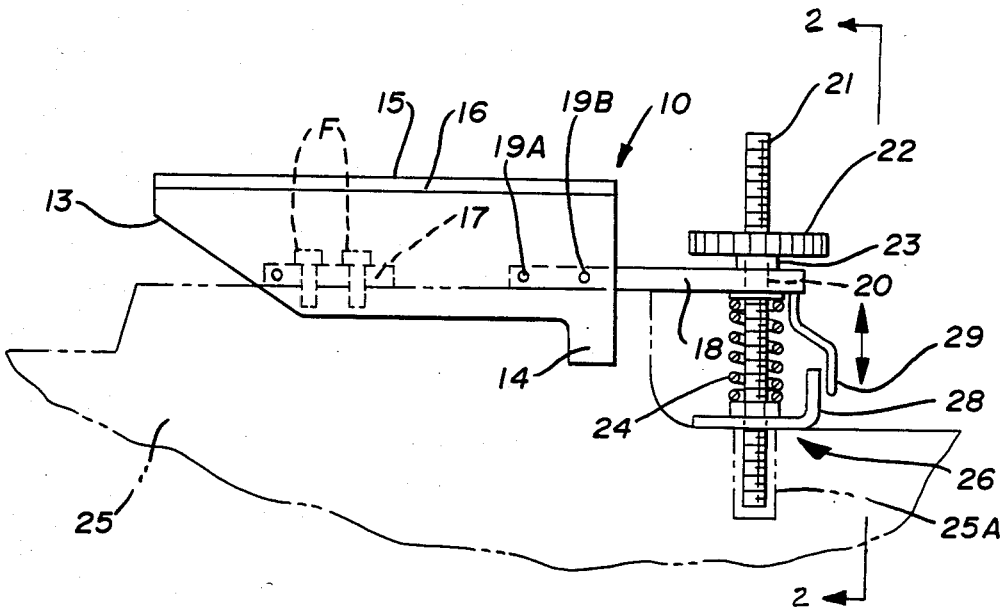
FIG. 1 is a side plan view of the bow sight mount on a crossbow stock.
Figure 2:
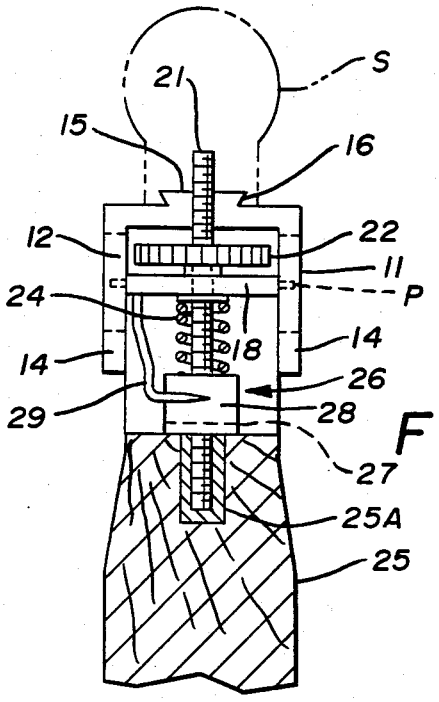
FIG. 2 is an end plan view on lines 2—2 of FIG. 1.
Figure 3:
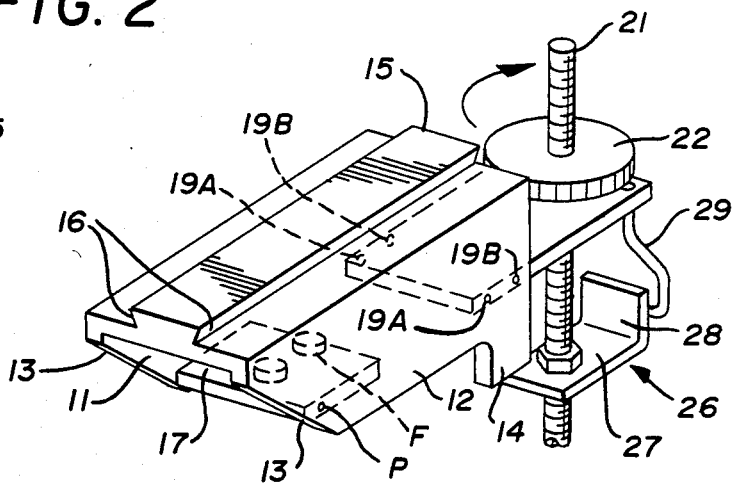
FIG. 3 is a perspective view of the bow sight mount.

A bow sight mount can be seen in FIGS. 1, 2, and 3 of the drawings comprising a main frame member 10 having oppositely disposed space parallel side arms 11 and 12 extending there from. Each of the arms 11 and 12 has an annularly disposed front end portion 13 and a down turned right angularly extending guide tab 14 on its opposite end portion. The main frame member has an elevated scope mounting track 15 positioned centrally there on extending longitudingly the entire length of said main frame member 10. The mounting track 15 has angularly disposed longitudinal edge configurations that are undercut at 16 providing the universal telescopic scope mount configuration for scopes (s) shown for illustration purposes only in broken lines in FIG. 2 of the drawings.

A stock mounting plate 17 has a generally rectangular shape and is positioned transversely between said arms 11 and 12 adjacent the angularly disposed front end portion 13 inwardly of a horizontal plane which intersects the outer most longitudinal ends of said arms 11 and 12. The stock mounting plate 17 is pivotally secured at one end by pivot pins P to each of the side arms 11 and 12 respectively and has a pair of centrally aligned apertures within. An adjustment arm 18 is positioned between and is secured to the side arms 11 and 12 at two points 19A and B parallel with said stock mounting plate 17. The adjustment arm 18 extends outwardly from between said arms; a distance equal to ⅓ the overall length of said main frame member 10 and is apertured inwardly from its free end at 20. A threaded rod 21 extends through said aperture at 20 having a thumb wheel 22 secured thereon adjacent said adjustment arm 18. The thumb wheel 22 has an enlarged shoulder 23 with a threaded bore within. The shoulder 23 is registerable on the upper portion of said threaded rod 21 which is of a diameter less than that of the aperture 20. A spring 24 is positioned on the threaded rod 21 between the adjustment arm 18 and lock nut, urging the adjustment arm 18 upwardly against the thumb wheel 18 as will be well understood by those skilled in the art.

A cross bow stock 25 can be seen in FIGS. 1 and 2 of the drawings onto which the bow sight mount is positioned by fasteners F through the apertures in the stock mounting plate 17. A threaded socket insert 25A is recessed within the bow stock 25 and is aligned to accept the threaded rod 21 extending through the adjustment arm 18 as herein before described.

In operation the vertical elevation of the bow sight mount can be adjusted incrementally by rotation of the thumb wheel 22 advancing same on the threaded rod 21 in corresponding adjustment arm 18 as indicated by the double arrows in FIG. 1 of the drawings.

An L-shaped bracket 26 has an aperture portion 27 and an upstanding portion 28. The L-shaped bracket 26 is positioned on the threaded rod 21 and held in place against the stock 25 by a lock nut as here and before described. A pointer arm 29 extends from an aperture in the adjustment arm 18 in a compound curve configuration to a point in front of said upstanding portion 28 of said L-shaped bracket 26 to indicate the relative position of said adjustment arm 18 in relation to said stock 25 by the use of indicia on said upstanding portion 28 of the L-shaped bracket 26.

An alternate adjustment configuration (not shown) would be self evident to those skilled in the art wherein the aperture at 20 in the adjustment arm 18 would be threaded so that the same would advance along the threaded rod 21 as the thumb wheel 22 is rotated. The threaded rod 21 would rotate freely in the socket positioned in the cross bow stock 25. It would also be well evident that incremental field marking indicia can be present on the rod 21 to provide an incremental positioning of the rod an index system so a previous position once located can be found again as would be required for different distances encountered in use of the cross bow.

Thus it will be seen that a new and novel device has been illustrated and described and it would be obvious to those skilled in the art the various changes and modifications may be made therein without departing from the spirit of the invention, therefore I claim:

1. A bow sight mount for use on cross bows comprises a main frame member having oppositely disposed down turned arms, a mounting plate pivotally secured between said arms and permanently secured to a bow stock, an adjustment arm extending outwardly from and between said arms, means on said adjustment arm adjustably connecting with said bow stock, means on said main frame member for mounting a telescopic sight thereon and means on said down turned arms for vertical guiding of said bow sight mount.

2. The bow sight mount of claim 1 wherein said mounting plate and said adjustment arm are on the same horizontal plane.

3. The bow sight mount of claim 1 wherein said means on said adjustment arm adjustably connecting with said bow sight comprises a rod and attached adjustment thumb wheel.

4. The bow sight mount of claim 1 wherein said means on said down turned arms for vertically guiding said bow sight mount comprises oppositely disposed dependent tabs extending from said arms respectively.

* * * * *